US009757629B2

(12) United States Patent
Seluga et al.

(10) Patent No.: US 9,757,629 B2
(45) **Date of Patent: *Sep. 12, 2017**

(54) GOLF CLUB HEAD HAVING STRESS-REDUCING FEATURES

(71) Applicant: Callaway Golf Company, Carlsbad, CA (US)

(72) Inventors: James A. Seluga, Carlsbad, CA (US); Matthew Myers, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 107 days.

This patent is subject to a terminal disclaimer.

(21) Appl. No.: 15/051,361

(22) Filed: Feb. 23, 2016

(65) Prior Publication Data

US 2016/0279489 A1 Sep. 29, 2016
US 2017/0216687 A9 Aug. 3, 2017

Related U.S. Application Data

(63) Continuation-in-part of application No. 14/997,199, filed on Jan. 15, 2016, which is a continuation of application No. 14/788,326, filed on Jun. 30, 2015, now Pat. No. 9,597,558, and a continuation-in-part of application No. 14/622,606, filed on Feb. 13, 2015, now Pat. No. 9,345,936, which is a continuation of application No. 13/906,572, filed on May 31, 2013, now Pat. No. 8,956,244, said application No. 14/997,199 is a continuation-in-part of application (Continued)

(51) Int. Cl.
*A63B 53/06* (2015.01)
*A63B 53/04* (2015.01)

(52) U.S. Cl.
CPC ..... *A63B 53/0466* (2013.01); *A63B 53/04* (2013.01); *A63B 2053/045* (2013.01); *A63B 2053/0408* (2013.01); *A63B 2053/0412* (2013.01); *A63B 2053/0433* (2013.01); *A63B 2053/0437* (2013.01); *A63B 2209/00* (2013.01)

(58) Field of Classification Search
CPC .. A63B 53/04; A63B 53/06; A63B 2053/0791
USPC ..... 473/324, 329, 330, 334, 340, 342
See application file for complete search history.

(56) References Cited

U.S. PATENT DOCUMENTS

| | | | |
|---|---|---|---|
| 5,766,094 | A | 6/1998 | Mahaffey et al. |
| 6,299,547 | B1 | 10/2001 | Kosmatka |
| 6,383,090 | B1 | 5/2002 | O'Doherty et al. |
| 6,852,038 | B2 | 2/2005 | Yabu |
| 6,979,270 | B1 | 12/2005 | Allen |
| 7,387,579 | B2 | 6/2008 | Lin et al. |
| 7,445,563 | B1 | 11/2008 | Werner |
| 7,914,393 | B2 | 3/2011 | Hirsch et al. |

(Continued)

FOREIGN PATENT DOCUMENTS

JP 3821516 9/2006

*Primary Examiner* — William Pierce
(74) *Attorney, Agent, or Firm* — Rebecca Hanovice; Michael Catania; Sonia Lari

(57) ABSTRACT

A golf club head comprising a body and a plurality of stiffening members is disclosed herein. The body comprises a face section, a sole section, and a crown section, and defines a hollow interior. Each of the plurality of stiffening members extends from the crown section to the sole section to reduce stresses placed on the face section during impact with a golf ball. The stiffening members are all located within 0.500 inch of a rear surface of the face section measured along a plane normal to the center of the face, and within 1 inch of the center of the face section along a horizontal axis parallel to the face section.

8 Claims, 5 Drawing Sheets

Related U.S. Application Data

No. 14/794,578, filed on Jul. 8, 2015, which is a continuation-in-part of application No. 14/755,068, filed on Jun. 30, 2015, now Pat. No. 9,623,302, which is a continuation-in-part of application No. 14/498,843, filed on Sep. 26, 2014, now Pat. No. 9,259,627, which is a continuation-in-part of application No. 14/173,615, filed on Feb. 5, 2014, now Pat. No. 9,180,349, which is a continuation-in-part of application No. 14/039,102, filed on Sep. 27, 2013, now Pat. No. 8,834,294, which is a continuation of application No. 13/797,404, filed on Mar. 12, 2013, now abandoned.

(60) Provisional application No. 61/684,079, filed on Aug. 16, 2012, provisional application No. 61/665,203, filed on Jun. 27, 2012.

(56) References Cited

U.S. PATENT DOCUMENTS

| | | | | |
|---|---|---|---|---|
| 8,523,702 | B2 | 9/2013 | Thomas et al. | |
| 8,540,587 | B2 | 9/2013 | Hirsch et al. | |
| 8,591,352 | B2 | 11/2013 | Hirano | |
| 8,608,585 | B2 | 12/2013 | Stites et al. | |
| 8,663,027 | B2 | 3/2014 | Morales et al. | |
| 8,834,293 | B2 | 9/2014 | Thomas et al. | |
| 8,834,294 | B1 * | 9/2014 | Seluga | A63B 53/04 473/338 |
| 8,956,244 | B1 * | 2/2015 | Westrum | A63B 53/04 473/338 |
| 9,067,110 | B1 * | 6/2015 | Seluga | A63B 53/06 |
| 9,180,349 | B1 * | 11/2015 | Seluga | A63B 53/04 |
| 9,216,332 | B1 * | 12/2015 | Ehlers | A63B 53/06 |
| 2015/0165280 | A1 | 6/2015 | Hebreo | |

* cited by examiner

GOLF CLUB HEAD HAVING STRESS-REDUCING FEATURES

CROSS REFERENCES TO RELATED APPLICATIONS

The present invention is a continuation-in-part of U.S. patent application Ser. No. 14/997,199, filed on Jan. 15, 2016, which is a continuation-in-part of U.S. patent application Ser. No. 14/788,326, filed on Jun. 30, 2015, and is also a continuation-in-part of U.S. patent application Ser. No. 14/794,578, filed on Jul. 8, 2015, both of which are continuations-in-part of U.S. patent application Ser. No. 14/755,068, filed on Jun. 30, 2015, which is a continuation-in-part of U.S. patent application Ser. No. 14/498,843, filed on Sep. 26, 2014, and issued on Feb. 16, 2016, as U.S. Pat. No. 9,259,627, which is a continuation-in-part of U.S. patent application Ser. No. 14/173,615, filed on Feb. 5, 2014, and issued on Nov. 10, 2015, as U.S. Pat. No. 9,180,349, which claims priority to U.S. Provisional Patent Application No. 61/898,956, filed on Nov. 1, 2013, and which is a continuation-in-part of U.S. patent application Ser. No. 14/039,102, filed on Sep. 27, 2013, and issued on Sep. 16, 2014, as U.S. Pat. No. 8,834,294, which is a continuation of U.S. patent application Ser. No. 13/797,404, filed on Mar. 12, 2013, now abandoned, which claims priority to U.S. Provisional Patent Application Nos. 61/665,203, filed on Jun. 27, 2012, and 61/684,079, filed on Aug. 16, 2012. The present application is also a continuation-in-part of U.S. patent application Ser. No. 14/622,606, filed on Feb. 13, 2015, and issued on May 24, 2016, as U.S. Pat. No. 9,345,936, which is a continuation of U.S. patent application Ser. No. 13/906,572, filed on May 31, 2013, and issued on Feb. 17, 2015, as U.S. Pat. No. 8,956,244, the disclosure of each of which is hereby incorporated by reference in its entirety herein

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a golf club head with stress-reducing features connecting a crown portion with a sole portion and disposed proximate a striking face section.

Description of the Related Art

The prior art discloses various golf club heads having interior structures. For example, Yabu, U.S. Pat. No. 6,852,038 for a Golf Club Head And Method OF Making The Same, discloses a golf club head with a sound bar, Galloway, U.S. Pat. No. 7,118,493 for a Multiple Material Golf Club Head discloses a golf club head with a composite aft body having an interior sound component extending upward from a sole section of a metal face component, Seluga et al., U.S. Pat. No. 8,834,294 for a Golf Club Head With Center Of Gravity Adjustability discloses a golf club head with a tube having a mass for adjusting the CG of a golf club head, and Dawson et al., U.S. Pat. No. 8,900,070 for a Weighted Golf Club Head discloses a golf club head with an interior weight lip extending from the sole towards the face. However, the prior art fails to disclose an interior structure that increases ball speed through reducing stress in the striking face section at impact, with a minimal increase in mass to the golf club head.

BRIEF SUMMARY OF THE INVENTION

The golf club head comprises interior structures connecting a crown section to a sole section to reduce the stress in a striking face section during impact with a golf ball. In some embodiments, the interior structures are hollow tubes or solid rods composed of a titanium alloy.

One aspect of the present invention is a golf club head comprising a body with a face, crown, sole, and hollow interior. A plurality of stiffening members connect the crown to the sole and are disposed a distance no more than 0.500 inch from a rear surface of the face measured along a plane normal to the center of the face. Each of the plurality of stiffening members may be a hollow tube or a solid rod having any cross-sectional shape. A central stiffening member is located within 0.250 inch of the center of the face, and each adjacent stiffening member is located within 1 inch of the center of the face.

Another aspect of the present invention is a golf club head comprising a body comprising a striking face section, a sole section and a crown section, the body defining a hollow interior, and at least one stiffening member extending from the crown section to the sole section, wherein the striking face section comprises a face center and a rear face surface facing the hollow interior, wherein the crown section comprises at least one crown aperture, wherein the at least one crown aperture corresponds to the at least one stiffening member, and wherein the at least one stiffening member is located less than 0.500 inch from the rear face surface along a vertical plane extending through the face center perpendicular to the striking face section. In some embodiments, the at least one stiffening member may comprise at least first, second, and third stiffening members, each of which may comprise a structure selected from the group consisting of a solid cylindrical rod and a hollow tube. In further embodiments, the solid cylindrical rod may be composed of a metal material and the hollow tube may be composed of a material selected from the group consisting of composite and titanium alloy. In another further embodiment, the first stiffening member may be located no more than 0.250 inch away from the face center along a horizontal axis extending parallel to the striking face section, and each of the second and third stiffening members may be located no more than 1 inch away from the center of the face along the horizontal axis.

In other embodiments, the at least one stiffening member may be an elongated cartridge comprising an upper portion, a lower portion, and a middle portion that extends parallel to the striking face section. In some of these embodiments, the sole may comprise a sole aperture, which may correspond to the lower portion of the elongated cartridge, and the crown aperture may correspond to the upper portion of the elongated cartridge. In another of these embodiments, the middle portion may be a hollow rectangular structure, and the elongated cartridge may be composed of a material selected from the group consisting of composite and titanium alloy. In yet another embodiment, the middle portion may comprise at least two vertical rods extending between the upper portion and the lower portion, and in a further embodiment, the middle portion may also comprise at least two diagonal rods extending between the at least two vertical rods. In yet another embodiment, the middle portion may comprise at least two piston assemblies.

Yet another aspect of the present invention is a golf club head comprising a body comprising a striking face section, a bottom section, and a top section, the body defining a hollow interior, and a plurality of stiffening members, each of the plurality of stiffening members extending from the top section to the bottom section, wherein the striking face section comprises a face center and a rear face surface facing the hollow interior, wherein the top section comprises a plurality of apertures, wherein each of the plurality of apertures corresponds to a stiffening member of the plurality of stiffening members, wherein the plurality of stiffening members comprises a first stiffening member, a second stiffening member, and a third stiffening member, and wherein the first stiffening member is located no more than 0.250 inch away from the face center along a horizontal axis extending parallel to the striking face section. In some embodiments, each of the second and third stiffening members may be located no more than 1 inch away from the center of the face along the horizontal axis. In another embodiment, at least one of the plurality of stiffening members may be selected from the group consisting of a solid cylindrical rod and a hollow tube. In a further embodiment, each of the plurality of stiffening members may be a solid cylindrical rod composed of a metal material, and each of the plurality of stiffening members may be located less than 0.500 inch from the rear face surface along a vertical plane extending through the face center perpendicular to the striking face section.

In some embodiments, the bottom section may comprise a plurality of bosses extending into the hollow interior, and each of the plurality of bosses may correspond to a stiffening member of the plurality of stiffening members. In other embodiments, each of the plurality of stiffening members may have a length ranging from 1 inch to 2.5 inches, and the body may have a volume ranging from 200 cubic centimeters to 475 cubic centimeters.

Having briefly described the present invention, the above and further objects, features, and advantages thereof will be recognized by those skilled in the pertinent art from the following detailed description of the invention when taken in conjunction with the accompanying drawings.

DETAILED DESCRIPTION OF THE INVENTION

Figure 1:
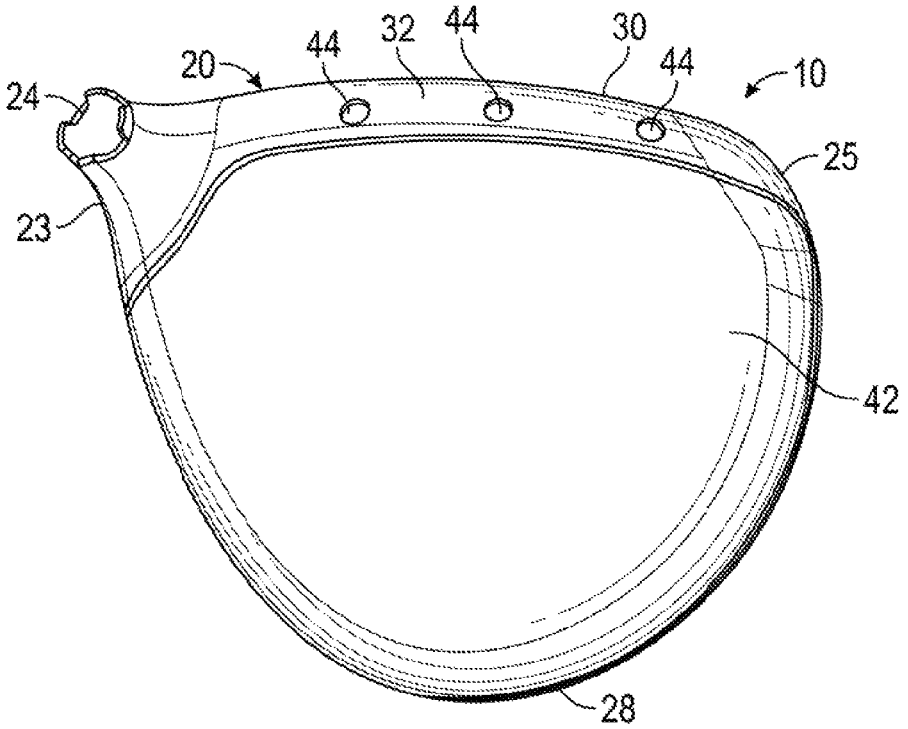
FIG. 1 is a top plan view of a first embodiment of the golf club head of the present invention.
Figure 2:
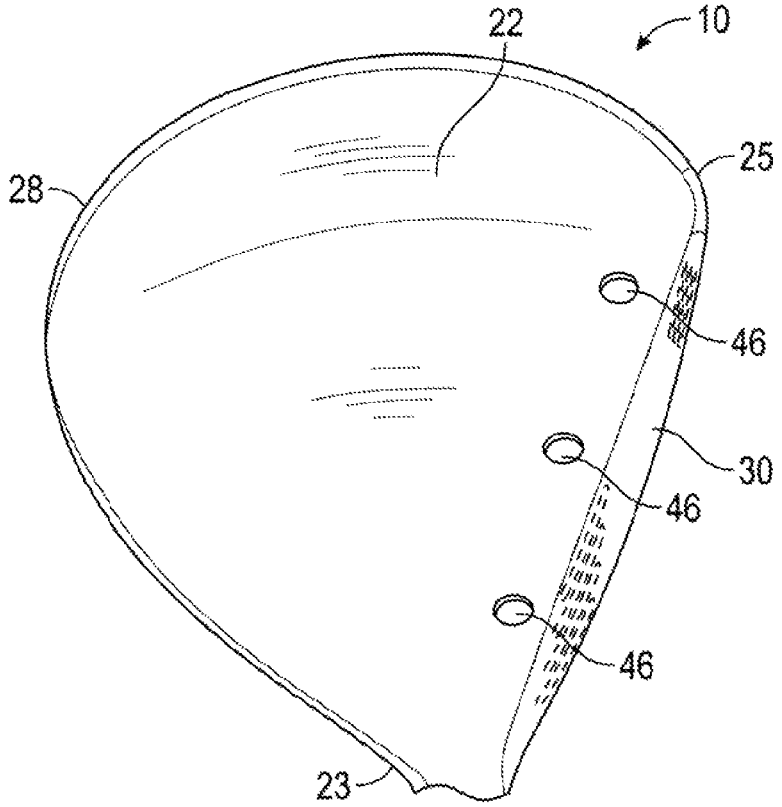
FIG. 2 is a sole perspective view of the golf club head shown in FIG. 1.

As shown in FIGS. 1-6, a preferred embodiment of the golf club head 10 of the present invention is generally designated. The golf club head 10 includes a body 20 having a sole section 22, a striking face section 30, a return section 32 extending away from an upper edge of the striking face section 30, a hosel 24 for engaging a shaft, a heel end 23, a toe end 25, an upper opening 26, a hollow interior 27, and an aft end 28. A crown section 40 is comprised of the return section 32 and a crown insert 42 that is placed over the upper opening 26 to enclose the hollow interior 27. Within the hollow interior 27, multiple stiffening members 50 (preferably two to eight) extend from the sole section 22 upward to the return section 32. In an alternative embodiment, the stiffening members 50 may extend to the crown insert 42 instead—what is important is that the stiffening members 50 connect the crown section 40 to the sole section 22.

Figure 3:
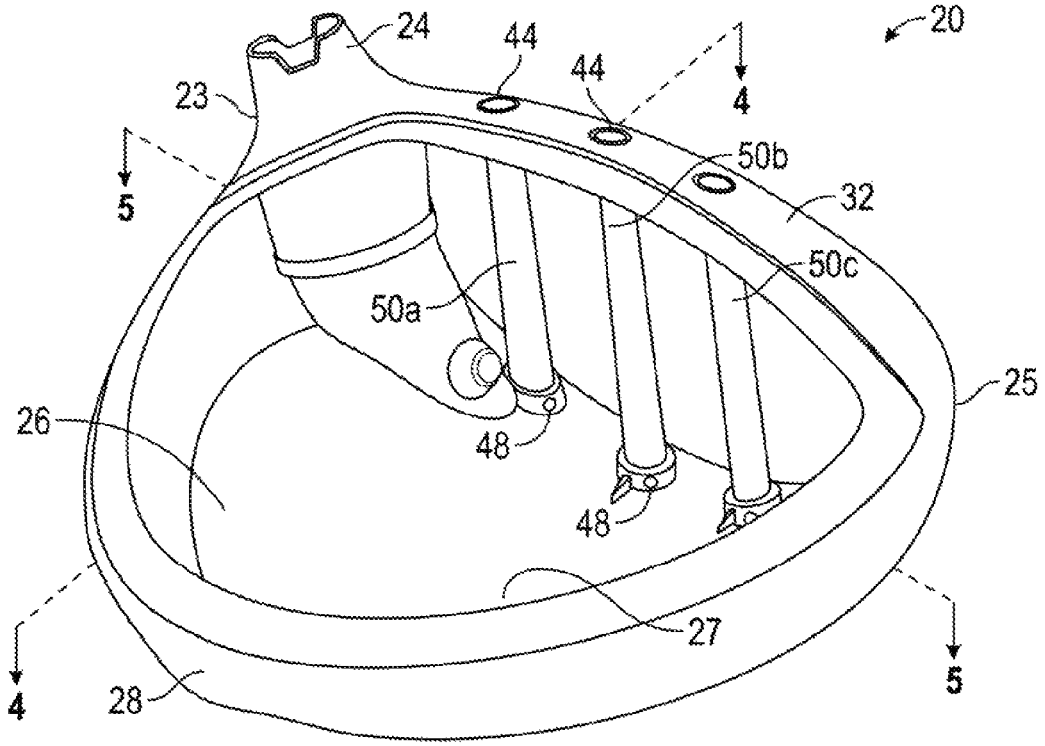
FIG. 3 is a top perspective view of the golf club head shown in FIG. 1 with the crown section removed to illustrate an interior.

As shown in FIG. 3, the preferred embodiment has three stiffening members 50*a*, 50*b*, 50*c*. Each of the stiffening members 50*a*, 50*b*, 50*c* in the preferred embodiment is a solid cylindrical rod composed of a lightweight, strong metal material such as titanium alloy or steel, though in an alternative embodiment the stiffening members 50*a*, 50*b*, 50*c* each may be a hollow tube made of a strong lightweight metal or a composite material. In another embodiment, the golf club head 10 may include one or more of both the solid rod and hollow tube types of stiffening members 50. In the preferred embodiment, each of the stiffening members 50 preferably has a diameter ranging from 0.050 inch to 0.200 inch and a length ranging from 1 to 2.5 inches. If any of the stiffening members 50 is a hollow tube, it preferably has a mass that ranges from 0.5 gram to 3 grams, more preferably from 1 gram to 2 grams, and most preferably 1.5 grams.

The return section 32 (or in the alternative embodiment, the crown insert 42) preferably comprises a plurality of upper apertures 44. Each of the plurality of upper apertures 44 preferably corresponds to one of the stiffening members 50. The sole section 22 also comprises a plurality of lower apertures 46, each of which leads to a boss 48 that extends upwards from the sole section 22 into the hollow interior 27. Each of the plurality of bosses 48 preferably corresponds to a stiffening member 50, which preferably is welded to the boss 48, but in alternative embodiments may be glued therein. Each of the plurality of stiffening members 50 may be inserted into the body 20 via the upper or lower apertures 44, 46.

In alternative embodiments, shown in FIGS. 7-10, the golf club head 10 has each of the elements of the preferred embodiment, except that the return section 32 comprises a single upper aperture 80 and the sole section 22 comprises a single lower aperture 85 located directly opposite the upper aperture 80. The apertures 80, 85 are sized to receive upper and lower portions 92, 94, respectively, of an elongated cartridge 90 having a stiffening middle portion 95, examples of which are shown in these Figures. The elongated cartridge 90 preferably is removable, and may have locking features that reversibly affix the upper and lower portions 92, 94 to the body 20, but in other embodiments may be permanently affixed to the golf club head 10 via welding or bonding.

Figure 7:
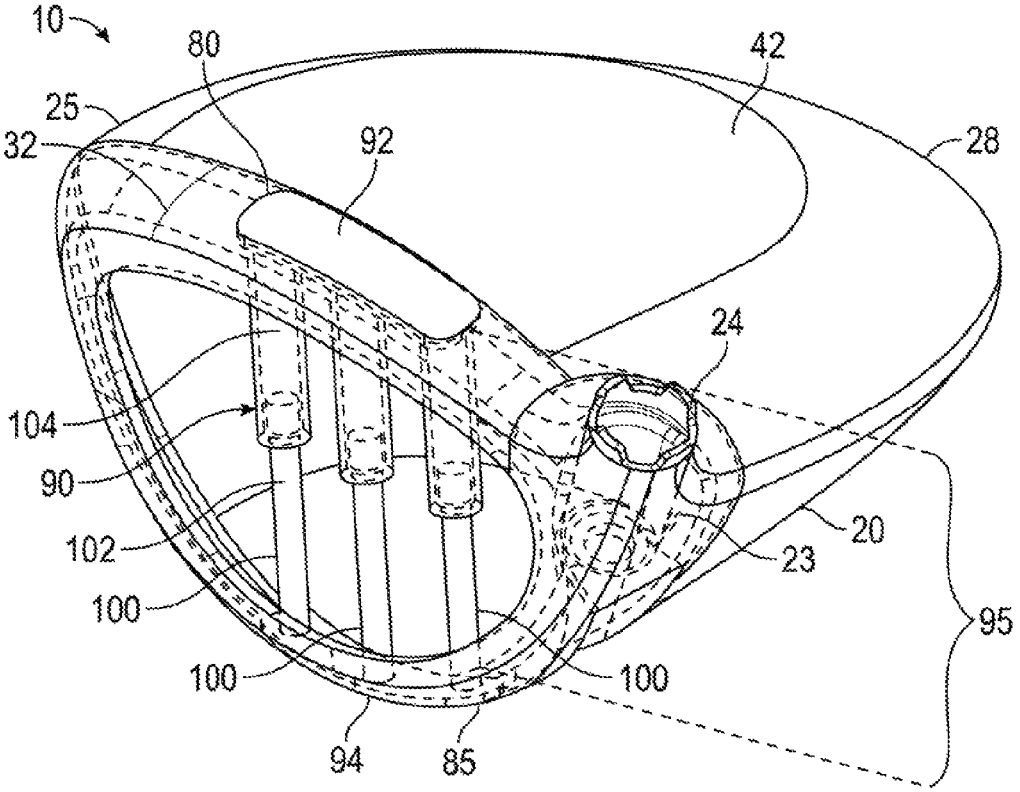
FIG. 7 is a top perspective view of a second embodiment of the golf club head of the present invention with its striking face section removed.
Figure 8:
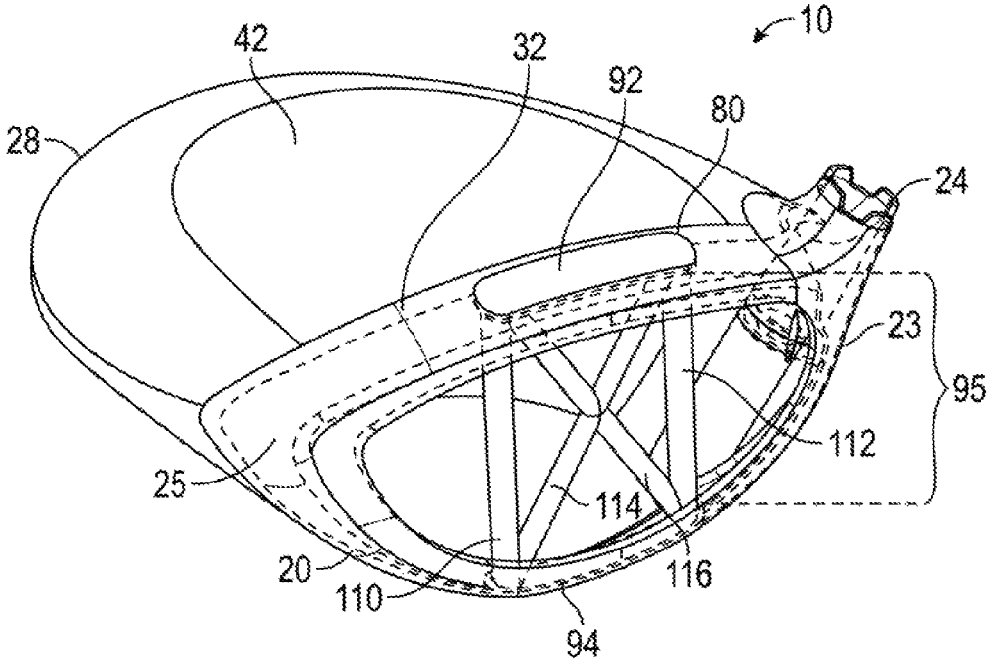
FIG. 8 is a top perspective view of a third embodiment of the golf club head of the present invention with its striking face section removed.
Figure 9:
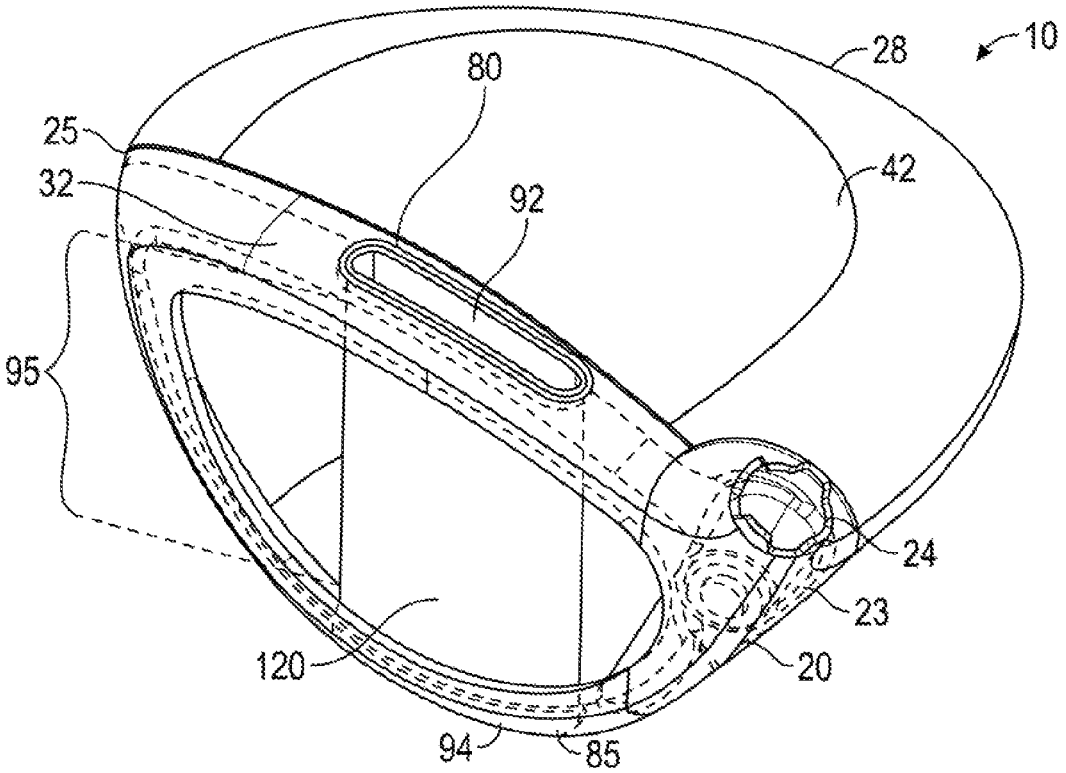
FIG. 9 is a top perspective view of a fourth embodiment of the golf club head of the present invention with its striking face section removed.
Figure 10:
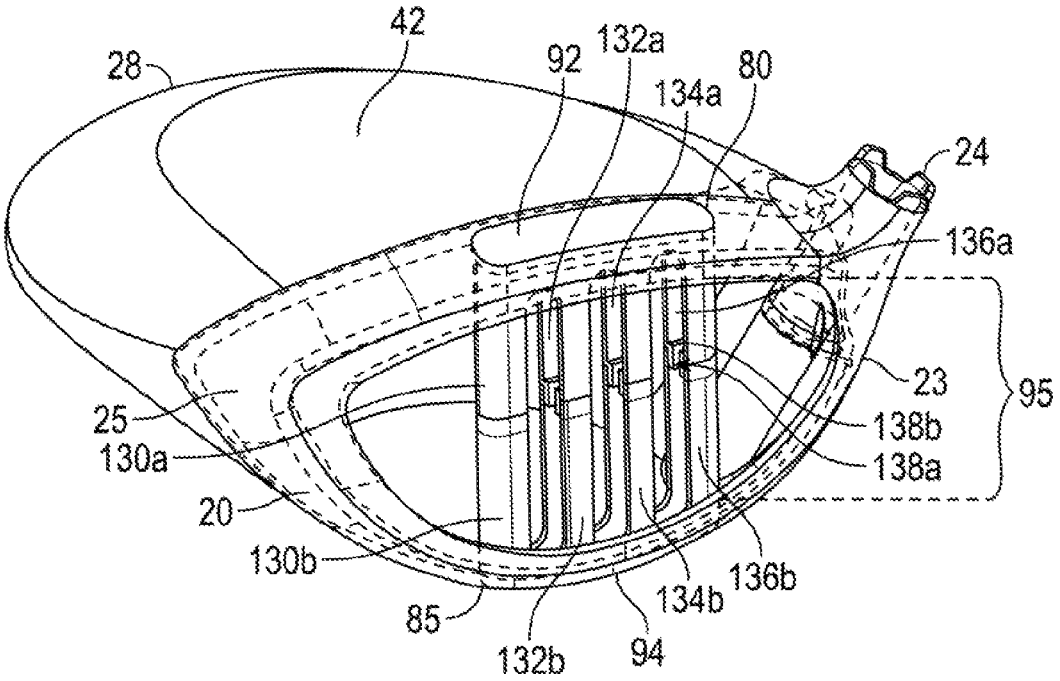
FIG. 10 is a top perspective view of a fifth embodiment of the golf club head of the present invention with its face portion removed.

In the embodiment shown in FIG. 7, the middle portion 95 of the elongated cartridge 90 includes three piston assemblies 100, each with a rod 102 and a tube 104 portion to permit compression of the elongated cartridge 90 when the golf club head 10 impacts a golf ball. The rod 102 is capable of sliding into the tube 104 when the elongated cartridge 90 is placed in compression. In the embodiment shown in FIG. 8, the middle portion 95 of the elongated cartridge 90 includes a pair of vertical rods 110, 112 extending between the upper and lower portions 92, 94 and a pair of diagonal rods 114, 116 extending between the vertical rods 110, 112 and forming an "X" shape. This X-shaped structure provides additional support for the vertical rods 110, 112 and thus the striking face section 30. In the embodiment shown in FIG. 9, the middle portion 95 of the elongated cartridge 90 is a hollow rectangular box 120 composed of one or more lightweight, strong materials such as carbon composite, steel, aluminum alloy, or titanium alloy.

The middle portion 95 does not have to be a unitary piece—it can be created from two or more parts. For example, in the embodiment shown in FIG. 10, the middle portion 95 of the elongated cartridge 90 comprises four approximately rectangular struts 130, 132, 134, 136. The struts 130, 132, 134, 136 are each formed from two pieces; four upper strut portions 130*a*, 132*a*, 134*a*, 136*a* extending downwards from the upper portion 92 of the elongated cartridge 90, and four lower strut portions 130*b*, 132*b*, 134*b*, 136*b* extending upwards from the lower portion 94 of the elongated cartridge 90. Each of the upper and lower strut portions 130*a*, 130*b*, 132*a*, 132*b*, 134*a*, 134*b*, 136*a*, 136*b* comprises a mating structure 138*a*, 138*b* so that these portions can securely grip each other when the elongated cartridge 90 is fully assembled. For example, in FIG. 10, the upper mating structure 138*a* is a slot and the lower mating structure 138*b* is a hook sized to lock onto the slot. The upper strut portions 130*a*, 132*a*, 134*a*, 136*a* preferably are integrally formed with the upper portion 92 and the lower strut portions 130*b*, 132*b*, 134*b*, 136*b* preferably are integrally formed with the lower portion 94.

The elongated cartridge 90 may be formed from one or more lightweight, strong materials, but preferably the upper and lower portions 92, 94 are formed of the same material as that of the body 20 of the golf club head 10, which may be steel or titanium alloy. In any of the embodiments shown in FIGS. 7-10, the various features making up the middle portion 95 may be composed of carbon composite, steel, titanium alloy, plastic, or other such materials.

Figure 4:
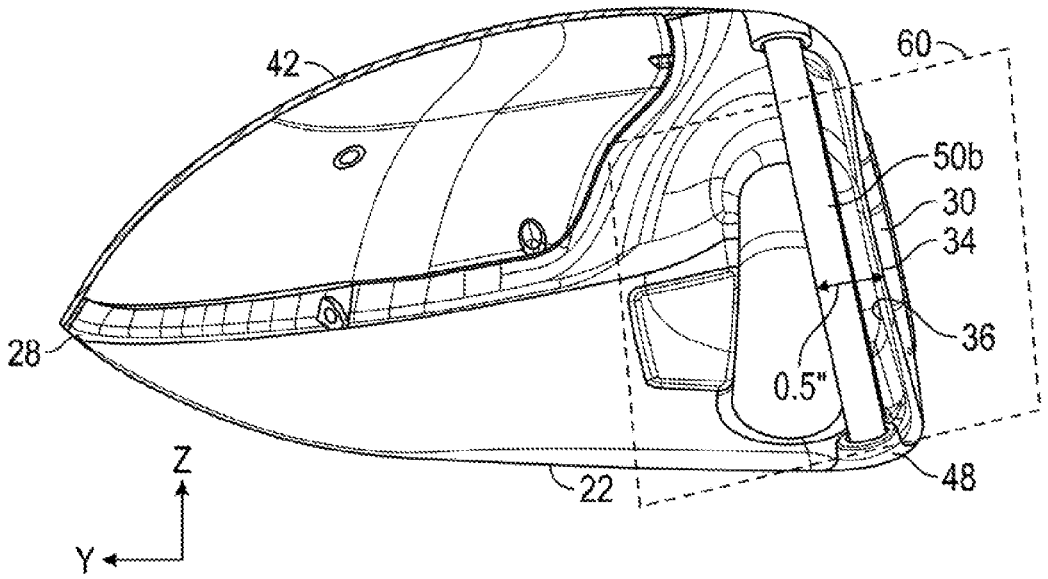
FIG. 4 is a cross-sectional view of the golf club head shown in FIG. 3 along lines 4-4.
Figure 5:
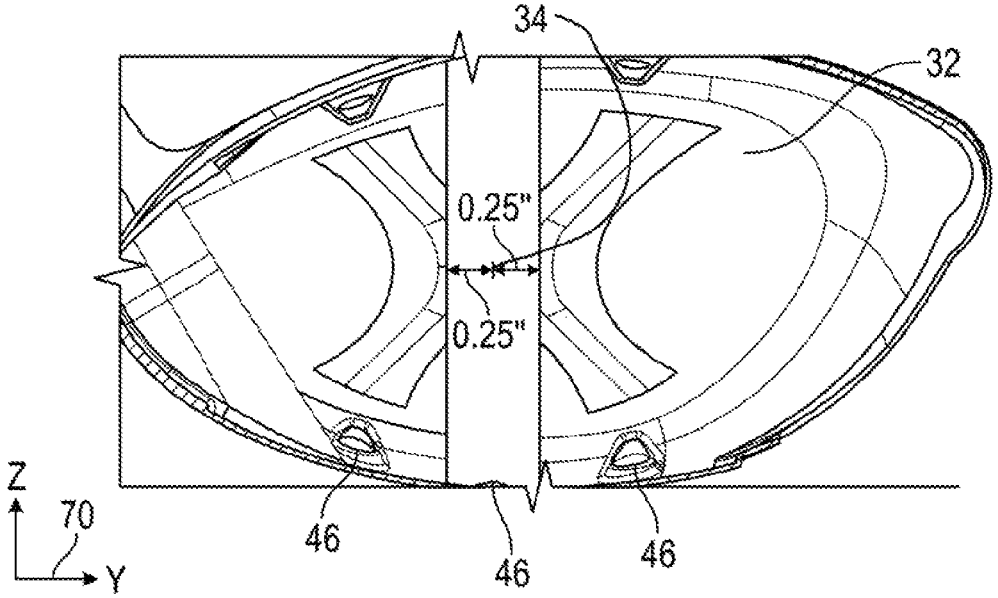
FIG. 5 is a cross-sectional view of the golf club head shown in FIG. 3 along lines 5-5 without the tubes.
Figure 6:
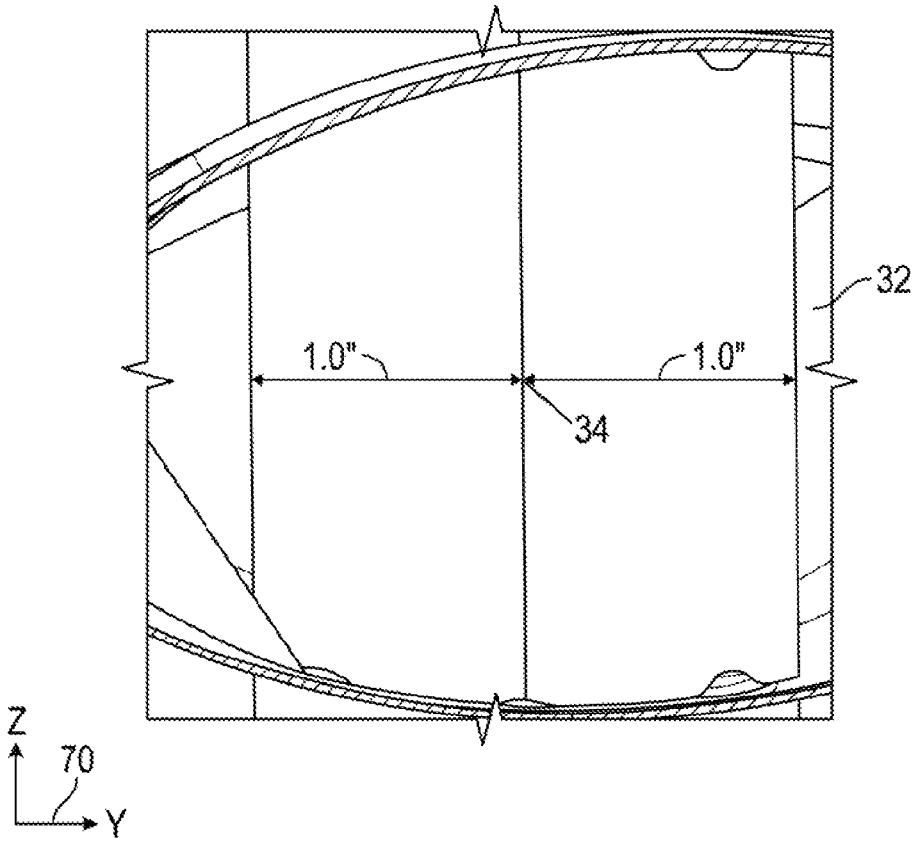
FIG. 6 is another view of the embodiment shown in FIG. 5.

As shown in FIG. 4, in each of the embodiments disclosed herein, each stiffening member 50 or feature of the stiffening middle portion 95 of the elongated cartridge 90 is located less than 0.500 inch from the rear surface 36 of the striking face section 30, and preferably less than 0.433 inch, measured along a vertical plane 60 extending through the face center 34 perpendicular to the striking face section 30. No portion of any stiffening member 50 or middle portion 95 should be disposed outside of this 0.500-inch range. As shown in FIG. 5, the middle stiffening member 50*b* or center-most structure of the middle portion 95 preferably is disposed within 0.250 inch, toe-wards or heel-wards, of the face center 34 along a horizontal Y-axis 70 extending parallel to the striking face section 30. The other two stiffening members 50*a*, 50*c*, or the outer edges of the middle portion 95 of the elongated cartridge 90, preferably are each disposed within 1 inch, toe-wards and heel-wards, of the face center 34 along the Y-axis 70.

Locating the stiffening members 50 or middle portion 95 of the elongated cartridge 90 within the region of the golf club head 10 defined above and in FIGS. 4 and 5 has the greatest stress-reducing effect on the golf club head 10. If any of the stiffening members 50 are placed more than 0.500 inch away from the rear surface 36 of the striking face section 30 or outside of the 0.250/1 inch range, they will not have a noticeable effect on the stress placed on the striking face section 30 when the golf club head 10 is in use, and will use up discretionary mass without creating a significant performance benefit.

In each of the embodiments disclosed herein, the golf club head 10 preferably has a Characteristic Time (CT) of the face close to, but not exceeding, the 257 microsecond ("μS") limit set by the USGA.

In any of the embodiments disclosed herein, when the golf club head 10 is designed as a driver, it preferably has a volume from 200 cubic centimeters to 600 cubic centimeters, more preferably from 300 cubic centimeters to 500 cubic centimeters, and most preferably from 420 cubic centimeters to 470 cubic centimeters, with a most preferred volume of 460 cubic centimeters. In the preferred embodiment, the golf club head 10 has a volume of approximately 450 cc to 460 cc.

The volume of the golf club head 10 will also vary between fairway woods (preferably ranging from 3-woods to eleven woods) with smaller volumes than drivers. When designed as a driver, the golf club head 10 preferably has a mass of no more than 215 grams, and most preferably a mass of 180 to 215 grams; when designed as a fairway wood, the golf club head 10 preferably has a mass of 135 grams to 200 grams, and preferably from 140 grams to 165 grams.

In each of the embodiments disclosed herein, the striking face section 30 preferably has a varying thickness such as that described in U.S. Pat. No. 7,448,960, for a Golf Club Head With Variable Face Thickness, which pertinent parts are hereby incorporated by reference. Other alternative embodiments of the thickness of the striking face section 30 are disclosed in U.S. Pat. No. 6,398,666, for a Golf Club Striking Plate With Variable Thickness, U.S. Pat. No. 6,471,603, for a Contoured Golf Club Face and U.S. Pat. No. 6,368,234, for a Golf Club Striking Plate Having Elliptical Regions Of Thickness, all of which are owned by Callaway Golf Company and which pertinent parts are hereby incorporated by reference. Alternatively, the striking face section 30 may have a uniform thickness.

In each of the embodiments disclosed herein, the body 20 is preferably cast from molten metal in a method such as the well-known lost-wax casting method. The metal for casting is preferably titanium or a titanium alloy such as 6-4 titanium alloy, alpha-beta titanium alloy or beta titanium alloy for forging, and 6-4 titanium for casting. Alternatively, the body 20 is composed of 17-4 steel alloy. Additional methods for manufacturing the body 20 include forming the body 20 from a flat sheet of metal, super-plastic forming the body from a flat sheet of metal, machining the body 20 from a solid block of metal, electrochemical milling the body 20 from a forged pre-form, casting the body using centrifugal casting, casting the body 20 using levitation casting, and like manufacturing methods.

In other embodiments, the golf club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478692, 6,582,323, 6,508,978, 6,592,466, 6,602,149, 6,607,452, 6,612,398, 6,663,504, 6,669,578, 6,739982, 6,758,763, 6,860,824, 6,994,637, 7,025,692, 7,070,517, 7,112,148, 7,118,493, 7,121,957, 7,125,344, 7,128661, 7,163,470, 7,226,366, 7,252,600, 7,258,631, 7,314,418, 7,320,646, 7,387,577, 7,396,296, 7,402,112, 7,407448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising:

a cast metal body comprising a striking face section, a sole section a return section, and an upper opening, the return section extending away from an upper edge of the striking face section and disposed between the striking face section and the upper opening;

a crown section disposed on the body to close the upper opening and define a hollow interior; and at least one stiffening member extending from the return section to the sole section, wherein the at least one stiffening member comprises a structure selected from the group consisting of a solid cylindrical rod and a hollow tube, wherein the striking face section comprises a face center and a rear face surface facing the hollow interior, wherein the return section comprises at least one return aperture, wherein the at least one return aperture corresponds to the at least one stiffening member, and wherein the at least one stiffening member is located a first distance of less than 0.433 inch from the rear face surface, the first distance measured along a plane extending through the face center, the plane extending along a vertical Z-axis and a horizontal X-axis extending perpendicular to the striking face section.

2. The golf club head of claim 1, wherein the at least one stiffening member comprises at least first, second, and third stiffening members.

3. The golf club head of claim 1, wherein the solid cylindrical rod is composed of a metal material and wherein the hollow tube is composed of a material selected from the group consisting of composite and titanium alloy.

4. The golf club head of claim 2, wherein the first stiffening member is located a second distance of no more than 0.25 inch away from the face center towards a heel side or a toe side of the body, the second distance measured along a horizontal Y-axis extending parallel to the striking face section and perpendicular to the vertical Z-axis and horizontal X-axis.

5. The golf club head of claim 4, wherein each of the second and third stiffening members is located no more than 1 inch away from the face center along the horizontal Y-axis.

6. A golf club head comprising:

a metal body comprising a striking face section, a sole section, a return section, and an upper opening, the return section extending away from an upper edge of the striking face section and disposed between the striking face section and the upper opening, a composite crown section disposed on the body to close the upper opening and define a hollow interior; and a plurality of stiffening members, each of the plurality of stiffening members extending from the return section to the sole section, wherein the striking face section comprises a face center and a rear face surface facing the hollow interior, wherein the return section comprises a plurality of apertures, wherein each of the plurality of apertures corresponds to a stiffening member of the plurality of stiffening members, wherein the plurality of stiffening members comprises a first stiffening member, a second stiffening member, and a third stiffening member, wherein each of the plurality of stiffening members has a length ranging from 1 inch to 2.5 inches, wherein each of the plurality of stiffening members is located a first distance of less than 0.433 inch from the rear face surface, the first distance measured along a plane extending through the face center, the plane extending along a vertical Z-axis and a horizontal X-axis extending perpendicular to the striking face section, wherein the first stiffening member is located a second distance of no more than 0.25 inch away from the face center towards a heel side or a toe side of the body, the second distance measured along a horizontal Y-axis extending parallel to the striking face section and perpendicular with the vertical Z-axis and horizontal X-axis, wherein each of the second and third stiffening members is located no more than 1 inch away from the center of the face along the horizontal Y-axis, wherein at least one of the plurality of stiffening members is selected from the group consisting of a solid cylindrical rod and a hollow tube, and wherein the body has a volume ranging from 200 cubic centimeters to 475 cubic centimeters.

7. The golf club head of claim 6, wherein each of the plurality of stiffening members is a solid cylindrical rod composed of a metal material.

8. The golf club head of claim 6, wherein the sole section comprises a plurality of bosses extending into the hollow interior, and wherein each of the plurality of bosses corresponds to a stiffening member of the plurality of stiffening members.

* * * * *